US009309715B2

(12) United States Patent
Miller et al.

(10) Patent No.: US 9,309,715 B2
(45) **Date of Patent: *Apr. 12, 2016**

(54) SHUTTER SLAT AND COMPACT SHUTTER ASSEMBLY

(71) Applicants: James V. Miller, Glen Ellyn, IL (US); Michael Heissenberg, Jensen Beach, FL (US)

(72) Inventors: James V. Miller, Glen Ellyn, IL (US); Michael Heissenberg, Jensen Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/732,308

(22) Filed: Jun. 5, 2015

(65) Prior Publication Data

US 2015/0267464 A1 Sep. 24, 2015

Related U.S. Application Data

(63) Continuation of application No. 13/772,285, filed on Feb. 20, 2013, now Pat. No. 9,074,411.

(60) Provisional application No. 61/600,901, filed on Feb. 20, 2012.

(51) Int. Cl.

| | |
|---|---|
| ***E06B 9/15*** | (2006.01) |
| ***E06B 9/58*** | (2006.01) |
| ***E06B 9/34*** | (2006.01) |
| ***E06B 9/11*** | (2006.01) |
| ***E06B 9/17*** | (2006.01) |
| *E06B 9/171* | (2006.01) |
| *E06B 9/00* | (2006.01) |

(52) U.S. Cl.

CPC ... *E06B 9/15* (2013.01); *E06B 9/11* (2013.01); *E06B 9/17* (2013.01); *E06B 9/34* (2013.01); *E06B 9/581* (2013.01); *E06B 9/171* (2013.01); *E06B 2009/005* (2013.01); *E06B 2009/1505* (2013.01); *E06B 2009/1544* (2013.01)

(58) Field of Classification Search

CPC ..... E06B 9/15; E06B 9/17; E06B 9/171; E06B 9/11; E06B 9/34; E06B 9/581; E06B 2009/1505; E06B 2009/1544; E06B 2009/005

USPC ..... 160/133, 235

See application file for complete search history.

(56) References Cited

U.S. PATENT DOCUMENTS 4,428,218 A * 1/1984 LaRocca ..... B21C 23/14 160/235

* cited by examiner

*Primary Examiner* — Blair M Johnson

(74) *Attorney, Agent, or Firm* — Ice Miller LLP

(57) ABSTRACT

A slat for use in a rolling shutter is provided. The slat comprises a engaging track located at a first edge of a body and a receiving track located at a second edge of the body. Illustratively, the engaging track has a hook-shaped profile, and the receiving track comprises a lip member and a guard member defining a space adapted to receive therein an engaging track of an adjacent slat. The engaging track and the receiving track are designed to minimize the space required for the rolling shutter to be retracted around a spindle.

10 Claims, 4 Drawing Sheets

SHUTTER SLAT AND COMPACT SHUTTER ASSEMBLY

This application is a continuation of U.S. application Ser. No. 13/772,285, filed Feb. 20, 2013, which claims the benefit of U.S. Provisional Application No. 61/600,901, filed Feb. 20, 2012.

FIELD OF THE INVENTION

The present invention relates to shutter slats and in particular to shutter slats of roller type having improved resistance to storms and break-ins. It furthermore relates to shutter slats having compact retraction capability.

BACKGROUND

Conventional roller shutters are designed to provide security from break-ins or protection from storms. Because such protection and security may not always be necessary or desired, such as during the day when a retail store is open for business or during fine weather when a homeowner wishes to open windows or enjoy an ocean view, roller shutters are designed to be retractable into a casing in which they are stored. In some examples, to facilitate compact storage, the rigid shutter slats that are designed to resist hurricane winds and burglars also must be capable of conforming to a roll.

One conventional shutter slat is made to conform to a roll by providing a loose articulation between slats. Slats are slidably engaged at the upper edge of one slat and the lower edge of another slat. The upper edge comprises a vertical projection terminating in a hook-shaped profile. The lower edge comprises a first portion and a second portion that cooperate to define a vertical pocket. The hook-shaped profile of the upper edge allows the upper edge to engage the first portion of the lower edge, also having a hook-shaped profile. The upper edge is prevented from undesirably disengaging the lower edge by the second portion of the lower edge, which comprises a guard extending downward to slightly below the hook-shaped profile of the lower edge, defining a horizontal aperture between the first and second portions of the lower edge. The vertical pocket defined by the first and second portions of the lower edge is similar in depth to the height of the vertical projection of the upper edge. This shutter configuration's flexibility arises from the pivoting of the vertical portion of the upper edge within the horizontal aperture.

One result of this configuration is that the upper edge has significant vertical clearance within the vertical pocket. Shutters according to this configuration are known to have a clearance up to one-quarter inch per slat, or even more. A shutter having 48 slats and one-quarter inch clearance per slat would then have a total clearance of twelve inches between the fully open and fully closed positions. To raise such a shutter having a torsion spring as a counterbalance, a user must lift the bottom slat either by hand or mechanically to correct for the full amount of clearance before the shutter will begin to retract. In such a shutter, a user would have to lift approximately 150 pounds by twelve inches in order to engage the shutter's retraction mechanism. Shutters of this configuration do not obtain full benefit of the counterbalance, as provided by the torsion spring or by other means.

A further result of this configuration is that the loosely articulated slats are known to be noisy. The slats rattle against each other during extension and retraction. In addition, when the roller shutter is deployed, the normal forces of the wind are sufficient to cause the slats to rattle audibly.

Conventional shutter slats are generally designed to hang from a roll or spindle, the roll or spindle contained in a casing. When the shutter is retracted, the slats wrap around the spindle. Because the slats do not fit together compactly around the roll, the resulting shutter assembly, when retracted, creates a roll with a large diameter, and therefore requires a large casing for the roll. This can be unsightly, especially in shutter applications used on residential buildings. Thus, a shutter assembly that is capable of compact storage is desirable.

One solution to the problem of compact storage includes the use of slats that are sized to fit snugly against each other, as described in U.S. Pat. No. 7,409,980 to Heissenberg, titled "Rolling Shutter Assembly." The slats in this configuration are substantially similar to the slats described in U.S. Pat. No. 6,095,225 to Miller. However, the slats are dimensioned such that the heights of the slats increase as the slats lie further away from the spindle at the center of the shutter. This configuration allows the slats to fit together more closely than U.S. Pat. No. 6,095,225 to Miller, as the c-shaped channels of the slats fit together in such a way that there is little wasted space between the bodies of the slats. However, the size of the c-shaped channels of these slats still causes the shutter to take up more space than is necessary when in the fully closed position. Furthermore, the shape of the c-shaped channels may cause the shutter to retain water, which can freeze and damage the slats.

Another solution to the problem of compact storage includes the use of slats that do not require large c-shaped channels, as described in U.S. Pat. No. 7,357,171 to Miller, titled "Low-Clearance Shutter Slat." The slats comprise engaging tracks and receiving tracks that are thinner than the c-shaped channels of U.S. Pat. No. 7,409,980 to Heissenberg. However, the engaging tracks and receiving tracks do not completely minimize the space taken up by the shutter in the fully closed position.

There is a need for shutter slats that minimize the space required for a rolling shutter made up of the slats to be wound up in a fully closed configuration. There is also a need for shutter slats that do not retain water, which can freeze and damage the slats.

SUMMARY

In one embodiment of the invention, a slat for use in a rolling shutter is described, having a body having a first edge, a second edge, an outward facing side extending along a convex curve between the first edge and the second edge, and an inward facing side extending along a concave curve between the first edge and the second edge; a engaging track connected to the body at the first edge, wherein the engaging track comprises a tip member, the tip member having an outer surface contiguous with the outward facing side of the body and an inner surface contiguous with the inward facing side of the body, the tip member disposed at an acute angle from the inward facing side of the body; and a receiving track connected to the body at the second edge, wherein the receiving track comprises a lip member having an outer lip surface and an articulating lip surface, the outer lip surface being contiguous with the inward facing side of the body, a guard member spaced apart from the lip member, the guard member having an outer guard surface and an articulating guard surface, an articulation space wherein a second engaging track of a second slat may hook the lip member through an aperture between the lip member and the guard member thereby forming a hinge, and a receptacle located between the lip member and the guard member that is separated from the articulation space by a first shoulder on the articulating lip surface and a second shoulder on the articulating guard surface.

The outer lip surface comprises a first lip surface, a first curved lip wall, a second curved lip wall, and a second lip surface, and the outer guard surface comprises a sloped guard wall and an outer guard wall, with the first curved lip wall and the sloped guard wall having a substantially similar curvature so that an identical first curved lip wall of a third identical slat can be aligned substantially flush with the sloped guard wall of the second slat.

In another embodiment of the invention, a slat for use in a rolling shutter comprises a body having a first edge, a second edge, an outward facing side extending along a convex curve between the first edge and the second edge, and an inward facing side extending along a concave curve between the first edge and the second edge; a engaging track connected to the body at the first edge, wherein the engaging track comprises a tip member, the tip member having an outer surface contiguous with the outward facing side of the body and an inner surface contiguous with the inward facing side of the body, the tip member disposed at an acute angle from the inward facing side of the body; and a receiving track connected to the body at the second edge, wherein the receiving track comprises a lip member having an outer lip surface and an articulating lip surface, the outer lip surface being contiguous with the inward facing side of the body, a guard member spaced apart from the lip member, the guard member having an outer guard surface and an articulating guard surface, an articulation space wherein a second engaging track of a second slat may hook the lip member through an aperture between the lip member and the guard member thereby forming a hinge, and a receptacle located between the lip member and the guard member that is separated from the articulation space by a first shoulder on the articulating lip surface and a second shoulder on the articulating guard surface, wherein when the first and second slat are linked together in a rolled position of the rolling shutter, the outer guard of the first slat is aligned with the body of the second slat.

In a further embodiment, a retractable rolling shutter assembly is operable between a retracted position and a deployed position, the shutter assembly comprising a spindle, a plurality of serially linked slats according to the aforementioned embodiments connected to the spindle; wherein the plurality of slats have bodies of varying heights, the height of each of the slats generally increasing as the distance from the spindle to each slat increases, such that the plurality of slats encircles the spindle in successive layers when the shutter assembly is retracted, and each successive layer of slats lies substantially flush against a previous layer of slats.

BRIEF DESCRIPTION OF THE DRAWINGS

Embodiments of the invention will now be explained in further detail by way of example only with reference to the accompanying figures, in which.

DETAILED DESCRIPTION

Figure 1:
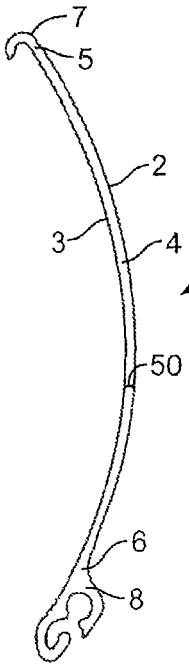
FIG. 1 is a side view of a shutter slat according to the present invention.
Figure 2:
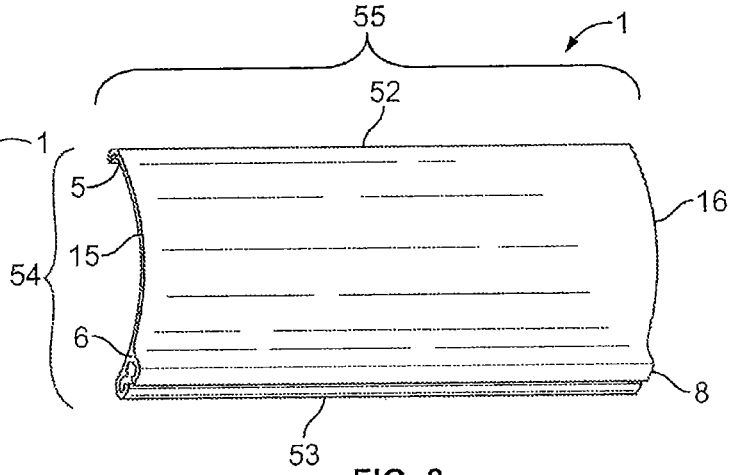
FIG. 2 is an elevation of a shutter slat according to the present invention.

FIGS. 1 and 2 show a shutter slat 1 according to the present invention. Illustratively, shutter slat 1 is an elongated body of single-ply extruded aluminum having a body portion 4, an engaging track 7, and a receiving track 8. The body portion 4 is bound by an outward facing side 2, an inward facing side 3, a first edge 5, a second edge 6, a first end 15 and a second end 16.

FIG. 1 is a side view of a shutter slat 1 according to the present invention. The body portion 4 is a curved single-wall having an outward facing side 2, an inward facing side 3, a first edge 5, and a second edge 6. The outward facing side 2 of body portion 4 has a convex cross-section and the inward facing side 3 has a concave cross-section when sectioned vertically at any location along the length of slat 1. The distance between outward facing side 2 and inward facing side 3 defines the thickness 50 of body portion 4.

Figure 11:
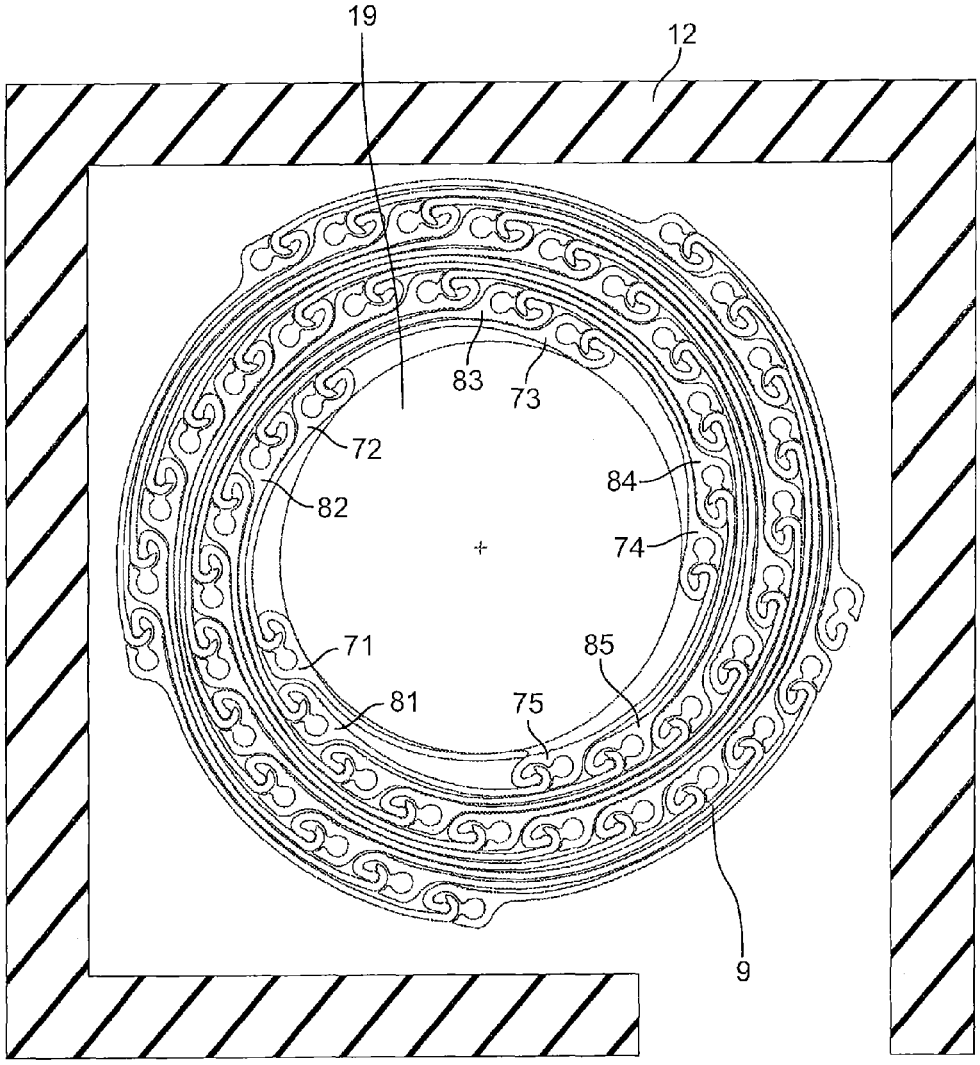
FIG. 11 is a side view of a rolling shutter made of the slats according to the present invention when the rolling shutter is in a fully closed position.

FIG. 2 is an elevation of a low-clearance shutter slat 1 according to the present invention. The distance between the upper end 52 of engaging track 7 and the lower end 53 of receiving track 8 defines the vertical height 54 of slat 1. As shown in FIG. 11, varying the vertical heights of the slats in a rolling shutter minimizes the space required to retract the rolling shutter into a fully closed position. In the embodiment of FIG. 11, the vertical heights of the slats of each rolling shutter increase as the slats lie further from the spindle.

The distance between first end 15 and second end 16 of body portion 4 defines the overall horizontal width 55 of slat 1. The overall horizontal width 55 must be wide enough to cover a building aperture or other opening which a rolling shutter is designed to protect.

Outward facing side 2 and inward facing side 3 are both formed with a curvature that allows the inward facing side 2 to conform to a roll wrapped around spindle 19 (see FIG. 11). The curvature of body portion 4, the overall vertical height 54, and the thickness 50 are selected to facilitate retraction and winding of a rolling shutter 9 formed from slats 1 around the spindle 19 and to provide strength to the rolling shutter 9.

Figure 3:
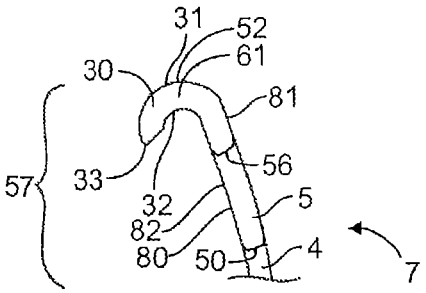
FIG. 3 a detailed view of a engaging track according to the present invention.

FIG. 3 is a detailed view of engaging track 7. Engaging track 7 is a hook-shaped member having a straight portion 80 having inward facing side 82 and outward facing surface 81. The engaging track 7 also has a tip member 30 with an outer surface 31, an inner surface 32, top bend 61, and a tip 33. The top bend 61 curves away from the straight portion 80 so that the tip 33 is disposed at an acute angle with the straight portion 80 on the inward facing side 82. Engaging track 7 is formed integrally with body portion 4 and is connected to body portion 4 at first edge 5. However, it is understood that engaging track 7 could be formed separately and fixed to body portion 4. It is also understood that engaging track 7 could, in the alternative, be located at second edge 6.

Outer surface 31 has a radius of curvature that in conjunction with the radius of curvature of inner surface 32 causes engaging track 7 to have a substantially uniform thickness 56 from tip 33 to first end 5 of body portion 4. In the embodiment shown, the thickness 56 of the straight portion 80 of engaging track 7 near the first edge 5 is slightly thicker than the thickness 50 of the body portion 4. Such an increase in thickness serves to strengthen the hinge formed by the engaging track of one slat 1*a* and the receiving track of an adjacent slat 1*b* (See FIG. 8) by preventing the engaging track from forcible disengagement from the receiving track.

Engaging track 7 also has a vertical height 57 that extends from first edge 5 to upper end 52. However, those skilled in the art will recognize that the vertical height 57 of engaging track 7 is not critical so long as engaging track 7 is dimensioned to engage receiving track 8.

In comparison with engaging tracks shown in the prior art, the engaging track 7 of the present slat minimizes the profile of the slat when it is wound in a roll.

Figure 4:
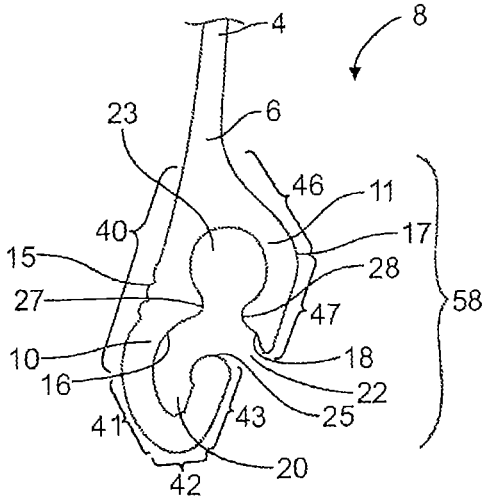
FIG. 4 a detailed view of a receiving track according to the present invention.

FIG. 4 is a detailed view of receiving track 8, which is connected to body portion 4 at second edge 6. Receiving track 8 includes a lip member 10, a guard member 11, and an articulation space 20. Receiving track 8 may also include a receptacle 23. Receiving track 8 is formed integrally with body portion 4. However, it is understood that receiving track 8 could be formed separately and fixed to body portion 4. It is also understood that receiving track 8 could, in the alternative, be located at first edge 5 if engaging track 7 is located at second edge 6.

Receiving track 8 has a vertical height 58 that extends from second edge 6 to lower end 53. However, those skilled in the art will recognize that the vertical height 58 of receiving track 8 is not critical so long as receiving track 8 is dimensioned to engage engaging track 7.

Figure 10:
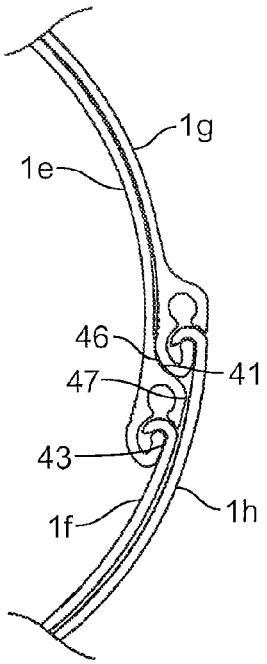
FIG. 10 is a detailed view of the cooperation of the engaging tracks and receiving tracks of four shutter slats according to the present invention when the shutter slats are in a fully closed position.

Lip member 10 is a hook-shaped member having an outer lip surface 15, an articulating lip surface 16, and a tip 25. Outer lip surface 15 further includes first lip surface 40, first lip curved wall 41, second lip curved wall 42, and second lip surface 43. First lip surface 40 of outer lip surface 15 is contiguous with inward facing side 3 of body portion 4 such that the curvatures of inward facing side 3 and first lip surface 40 are the same, and there is no break between inward facing side 3 and first lip surface 40 of outer lip surface 15. This common curvature minimizes the space taken up by slat 1, as body portion 4 and lip member 10 of a first slat 1*g* can lie flush against the body portion 4 of a second slat 1*e*, as shown in FIGS. 10 and 11.

Figure 9:
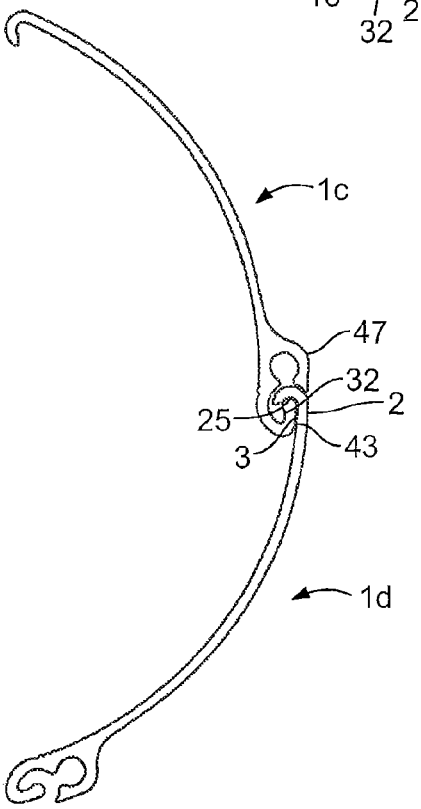
FIG. 9 is a side view of the cooperation of two shutter slats according to the present invention when the shutter slats are in a fully closed position.

First lip curved wall 41 and second lip curved wall 42 are contiguous with first lip curved wall 41, and bend toward the outward facing side of the slat. The second lip surface 43 is contiguous with second lip curved wall 42, and extends substantially parallel to first lip surface 40. When the shutter is in a retracted position, second lip surface 43 is aligned with the inward surface 82 of the straight portion 80 of engaging track 7 of a linked slat, as illustrated by FIG. 9. This relation between the second lip surface 43 and inward facing surface 82 provides a limit for the articulation of two linked slats.

Guard member 11 has an outer guard surface 17 and an articulating guard surface 18 disposed at the end of the guard member 11 distal from the slat body. As shown, articulating surfaces 16 and 18 may be wholly or partially concave. Such concave articulating surfaces allow for improved articulation between adjacent slats without the need to provide additional vertical clearance.

Outer guard surface 17 includes sloped guard wall 46 and outer guard wall 47. Second lip surface 43 and outer guard wall 47 have the same curvature as outward facing side 2 and inward facing side 3 of body portion 4, and second lip surface 43 and outer guard wall 47 are offset a distance equal to the thickness 50 of body portion 4. This configuration allows the inward facing side 3 of body portion 4 of a second slat 1 to lie flush against second lip surface 43 of the first slat 1 and form a flush surface between the outer guard wall 47 of the first slat 1 and the outward facing side 2 of the body portion 4 of the second slat 1. This allows the body portion 4 of a third slat 1 to lie flush against the outward facing side 2 of the body portion 4 of the second slat 1 and the outer guard wall 47 of the first slat 1.

This configuration is shown in FIG. 10. Second lip surface 43 and outer guard wall 47 of slat 1*e* are offset a distance approximately equal to the thickness 56 of the straight portion 80 of the slats 1*e-h*. The inward facing side 3 of body portion 4 of slat 1*f* lies flush against the second lip surface 43 of slat 1*e*, and forms a flush outer surface between outer guard wall 47 of slat 1*e* and outward facing side 2 of body portion 4 of slat 1*f*. The inward facing side 3 of body portion 4 of slat 1*h* is thereby able to lie flush against the outward facing side 2 of body portion 4 of slat 1*f* and the outer guard wall 47 of slat 1*e*.

First curved lip wall 41 and sloped guard wall 46 also have complementary curvatures so that the first curved lip wall 41 of one slat 1 can be aligned substantially flush with the sloped guard wall 46 of a second slat 1. This relationship can be seen in FIG. 10, where the first curved lip wall 41 of slat 1*g* is aligned so that it is substantially flush with the sloped guard wall 46 of slat 1*e*. The sloping nature of the sloped guard wall 46 and first curved lip wall 41 assist the slats to align themselves with one another when winding the slat reel. This design serves to further reduce the profile of slat 1, and further reduce the space taken up by a rolling shutter 9 in the retracted position.

Articulation space 20 is the space within which a engaging track 7 of an adjacent slat 1 is received in receiving track 8 to form a rolling shutter 9. The articulation surface 16 and tip 25 of lip member 10, and the articulating guard surface 18 of guard member 11 define the articulation space 20. The tip 25 of lip member 10 and articulating guard surface 18 of guard member 11 define an aperture 22 opening into articulation space 20. The profile of articulation space 20 is dimensioned so that it is substantially completely occupied by the engaging track 7 when two slats are connected in a deployed position.

Figure 6:
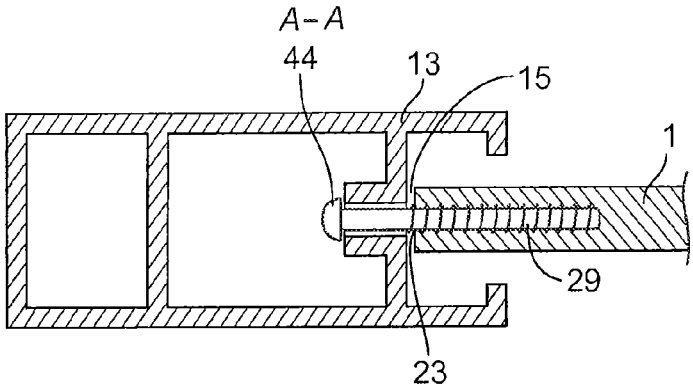
FIG. 6 is a partial horizontal sectional view of a shutter slat according to the present invention engaged in a track, taken along lines A-A of FIG. 5.

Receptacle 23 is adapted to receive a retention or alignment device 29 (FIG. 6). Articulating lip surface 16 has a shoulder 27 which separates articulation space 20 from receptacle 23, and articulating guard surface 18 has a shoulder 28 which separates articulation space 20 from receptacle 23. When slat 1 is in a vertical position, receptacle 23 is located above shoulders 27 and 28. As shown in FIG. 4, it is advantageous to locate receptacle 23 between body portion 4 and aperture 22. It is understood that if receiving track 8 were located at first edge 5 of slat 1, receptacle 23 still would be located between body portion 4 and aperture 22.

While receptacle 23 is a space distinct from articulation space 20 and separated by shoulders 27 and 28, as shown, receptacle 23 has a portion that is open to and in communication with articulation space 20. The engaging track 7 of an adjacent slat 1 cannot enter the gap between shoulders 27 and 28 and cannot be retained in receptacle 23. Although receptacle 23 is in open communication with articulation space 20, receptacle 23 is protected from the collection of dirt and grime by lip member 10 and guard member 11, and by the engaging track 7 of an adjacent slat 1. If desired, it is understood that receptacle 23 may be completely separated from articulation space 20. In such an embodiment, shoulders 27 and 28 would be connected to provide a single, continuous articulating surface.

Figure 5:
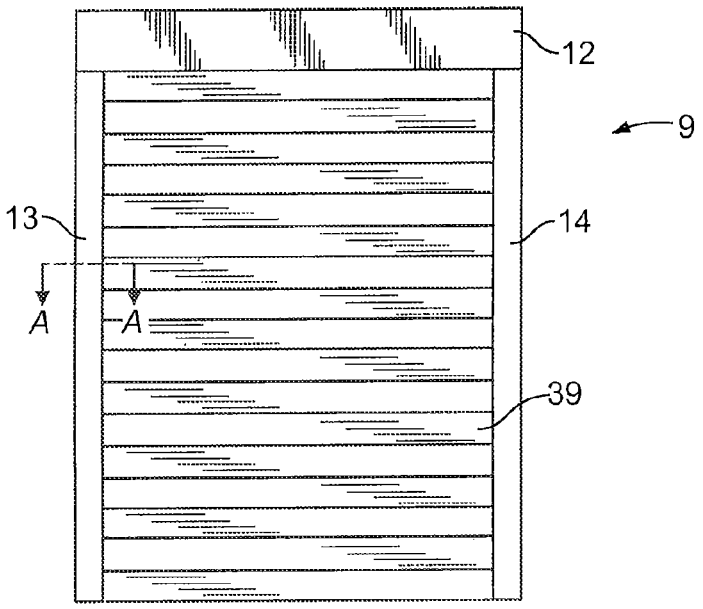
FIG. 5 is an elevation of a window aperture including a rolling shutter according to the present invention.

FIG. 5 shows an elevation of a plurality of shutter slats 1 according to the present invention, articulated into a rolling shutter 9 which may be installed on a building aperture 39 such as a window or door. Details of building aperture 39 are not illustrated for the sake of clarity. Building aperture 39 is further equipped with shutter casing 12 and a pair of guides 13 and 14, located on opposite lateral edges of building aperture 39. Rolling shutter 9 may be rolled up for storage within shutter casing 12. The first and second ends 15 and 16 of each slat 1, as shown in FIG. 2, are adjacent guides 13 and 14. Retention screw 29 provides for secure alignment of ends 15 and 16 with guides 13 and 14.

FIG. 6 is a partial sectional view taken along lines A-A of FIG. 5. A slat 1 is shown in combination with a guide 13 and a retention device 29. A retention device 29, such as a screw, is preferably inserted in receptacle 23 of slat 1 for use with guide 13. The head 44 of the retention device 29 protrudes from receptacle 23 and slides within vertical guide 13 provided at the end of rolling shutter 9. In this illustrative embodiment, retention device 29 does not restrict the rotation or pivoting of engaging track 7 within receiving track 8. As illustrated, for minimization of the rolling shutter, the diameter of the head 44 of retention device 29 is not larger than the external profile of receiving track 8. Because of the space between head 44 of screw 29 and first end 15 of slat 1, the receiving track 8 of one slat 1 may slide horizontally with respect to the engaging track 7 of another slat 1. The amount of horizontal sliding may be limited in part by the space between head 44 of retention device 29 and first end 15 of slat 1 or by the configuration of guides 13 and 14. An extended screw 62 (not shown) with an extension member 63 may be used in place of screw 29. Extension member 63 of extended screw 62 is longer than head 44 of screw 29 and is better adapted to retain rolling shutter 9 within guides 13 and 14 during either an attempted break in or extreme wind conditions. An example of an extended screw 62 is disclosed in U.S. Pat. No. 7,784,522. Alternatively, an alignment device may be set in receptacle 23 which simply restricts the slats sharing the associated hinge from sliding horizontally with respect to each other.

Figure 7:
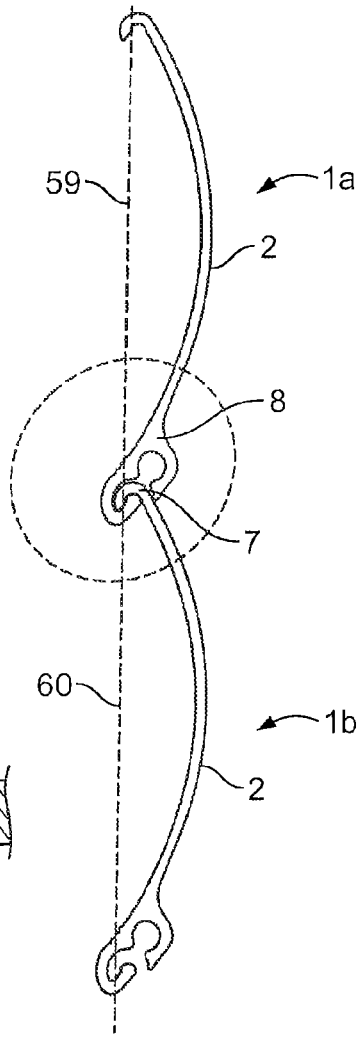
FIG. 7 is a side view of the cooperation of two shutter slats according to the present invention when the shutter slats are in an open position.
Figure 8:
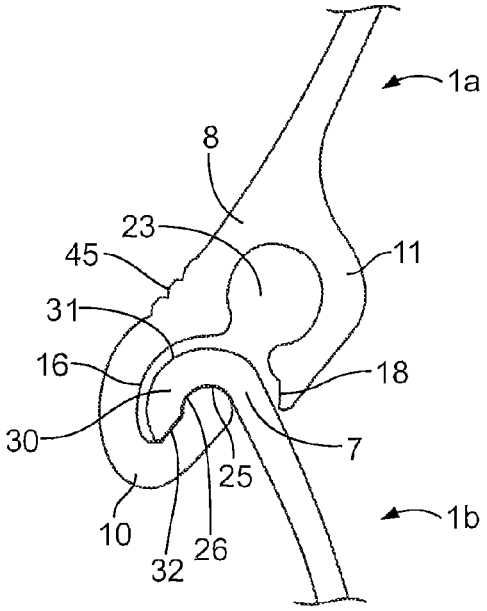
FIG. 8 is a detailed view of the cooperation between the engaging track and receiving track of two shutter slats according to the present invention when the shutter slats are in an open position.

FIG. 7 is a side view showing the cooperation of two slats 1*a* and 1*b* according to the present invention, and FIG. 8 is a detailed view of the cooperation of receiving track 8 of slat 1*a* and engaging track 7 of slat 1*b*. Both FIG. 7 and FIG. 8 show slats 1*a* and 1*b* engaging one another when the shutter slats are in a deployed position, covering a building aperture. As shown in FIG. 7, the bottom slat 1*b* is in a vertical position, i.e. the position as in an open shutter, with the vertical axis 59 of slat 1*a* substantially or completely in line with the vertical axis 60 of slat 1*b*. As discussed below, there is very little clearance space provided between slats. Still, bottom slat 1*b* can articulate in a clockwise direction.

As shown in FIG. 8, engaging track 7 of slat 1*b* is slidably engaged with receiving track 8 of slat 1*a* to form a hinge between slats 1*a* and 1*b*. The outer surface 31 of tip member 30 of slat 1*b* is convex and seats against the articulation surface 18 of guard member 11 of slat 1*a*. Lip member 10 of slat 1*a* retains tip member 30 of slat 1*b* in articulation space 20. Tip 25 of lip member 10 of slat 1*a* extends into a space defined by tip member 30 of slat 1*b*. Tip 25 of lip member 10 of slat 1*a* also has a bulge 26 that extends slightly into articulation space 20, providing additional security to the hinge formed by engaging track 7 of slat 1*b* and receiving track 8 of slat 1*a*. Inner surface 32 of tip member 30 of slat 1*b* seats against tip 25 of lip member 10 of slat 1*a*. In this position, articulation space 20 is almost entirely occupied by tip 30 of engaging track 7, with almost no clearance between shutter slats 1*a* and 1*b*. This configuration also limits the articulation of slats with respect to one another.

Guard member 11 shields the connection of engaging track 7 of slat 1*b* and lip member 10 of slat 1*a*, preventing engaging track 7 of slat 1*b* from disengaging from receiving track 8 of slat 1*a*. Guard member 11 also protects engaging track 7 of slat 1*b* and lip member 10 of slat 1*a* from exposure to forces applied to the outward facing sides 2 of slats 1*a* and 1*b*. In the open position, the weight bearing portion of receiving track 8 is lip member 10. Because engaging track 7 of slat 1*b* does not bear directly upon guard member 11 of slat 1*a*, damage to the outward facing side 2 of slat 1*a*, and to guard member 11 of slat 1*a*, is less likely to disengage the articulation between shutter slats 1*a* and 1*b* than in prior art shutters in which an exposed portion of the lower track was weight bearing.

In this embodiment, receiving track 8 may have notches 45 engraved on the surface of lip member 16. These notches may be used to indicate the height of the slat, in applications where slats of more than one height are used in the same shutter assembly. For example, the shortest slat of a set may have one notch 45, the next tallest slat having two notches, and so forth.

FIG. 9 is a side view showing the cooperation of two engaged slats 1*c* and 1*d* when the shutter slats are in a fully retracted position. As shown, the body portions 4 of slats 1*c* and 1*d* form a substantially circular arc when the slats are in a fully closed position. This allows numerous slats to be rolled together on a spindle 19, as shown in FIGS. 10 and 11.

Tip 25 of lip member 10 of slat 1*c* lies flush against inner surface 32 of tip member 30 of slat 1*d*, similar to how the tip 25 and inner surface 32 are configured in FIG. 7. Slight movement between tip 33 of tip member 30 of slat 1*b* and lip member 10 of slat 1*a* may permit slat 1*b* to extend beyond vertical alignment.

In addition, it can that second surface 43 of the receiving track 8 of slat 1*c* lies flush against inward facing side 3 of the slat 1*d*. This limits the articulation between slats 1*c* and 1*d* and contributes to the compact profile of the hinge formed by slats 1*c* and 1*d*. It can also be seen that at this limit, the outward facing side 2 of slat 1*d* has the same curvature and lies flush with outer guard wall 47. This configuration allows slats 1 to lie flat against the surface formed by outer guard wall 47 and side 2, reducing the overall volume of the roll when the slats are rolled around a spindle.

FIG. 10 is a side view showing how four slats (1*e*, 1*f*, 1*g* and 1*h*) lie flush together when the slats are in a fully retracted position. Slats 1*e* and if form part of an inner winding of slats around spindle 19. The inward facing side 82 of straight portion 80 of slat 1*f* lies flush against the second lip surface 43 of slat 1*e*, thereby forming a contiguous, flush surface between the outer guard wall 47 of slat 1*e* and the outward facing side 2 of body portion 4 of slat 1*f*. Slats 1*g* and 1*h* are hinged together in the same way and form part of a second winding around spindle 19. The inward facing side 3 of body portion 4 of slat 1*h* lies flush against the outer guard wall 47 of slat 1*e* and the outward facing side 2 of body portion 4 of slat 1*f*. The first lip curved wall 41 of slat 1*g* lies flush against the sloped guard wall 46 of slat 1*e*. The configuration of slats 1*e-h* demonstrates the minimal amount of space needed to layer a series of slats 1 when the rolling shutter 9 is in a fully closed position. Furthermore, the complementary slopes of first lip curved wall 41 and an associated sloped guard wall 46 of slat 1*e* help guide successive windings of slats to lie flush against one another in the configuration shown in FIG. 10 when the shutter assembly is being retracted.

FIG. 11 is a side view of a rolling shutter 9 with slats rolled up into shutter casing 12. The slats are divided into windings of increasing diameter which successively encircle spindle 19. In the embodiment of FIG. 11, the slats of each winding have the same vertical height within each winding, but have different vertical heights than the slats of other subassemblies. The first winding 70 that essentially encircles spindle 19 comprises slats 71-75. The second winding 80 that essentially encircles the first winding 70 comprises slats 81-85. Each subsequent winding essentially encircles the previous winding and also comprises five slats. The slats 71-75 of the first winding 70 have the shortest vertical height 76, and the slats of subassemblies further from the spindle 19 have longer vertical heights. For example, the vertical heights 86 of slats 81-85 are longer than the vertical heights 76 of slats 71-75, and the vertical heights of the slats of the subsequent subassemblies are longer than vertical height 86. The rolling shutter 9 formed of slats 1 has a smaller overall radius in the fully closed position than the rolling shutter disclosed in U.S. Pat. No. 7,409,980 because the engaging tracks 7 and the receiving tracks 8 of the slats 1 take up less overall space. Although there is very little vertical space provided between the slats, the slats articulate freely enough such that rolling shutter 9 fits compactly into shutter casing 12. Those skilled in the art will recognize that each winding of slats may be made with fewer than, or more than, five slats per winding.

Modifications in addition to those described above may be made to the structures and techniques described herein without departing from the spirit and scope of the invention. Accordingly, although specific embodiments have been described, these are examples only and are not limiting on the scope of the invention.

What is claimed is:

1. A slat for use in a rolling shutter, comprising:

a body having a first edge, a second edge, an outward facing side extending along a convex curve between the first edge and the second edge, and an inward facing side extending along a concave curve between the first edge and the second edge;

an engaging track connected to the body at the first edge, wherein the engaging track comprises a tip member, the tip member having an outer surface contiguous with the outward facing side of the body and an inner surface contiguous with the inward facing side of the body, the tip member disposed at an acute angle from the inward facing side of the body; and a receiving track connected to the body at the second edge, the receiving track comprising a lip member having an outer lip surface contiguous with the inward facing side of the body, and a guard member having an outer guard surface, wherein the lip member and the guard member define an aperture for receiving the engaging track of another slat to form a hinge; and wherein the outer lip surface further comprises a first lip surface, a first curved lip wall, a second curved lip wall, and a second lip surface, and the outer guard surface further comprises a sloped guard wall and an outer guard wall, and the second lip surface and the outer guard wall having substantially the same curvature as the outward facing side and the inward facing side of the slat.

2. A slat for use in a rolling shutter, comprising:

a body having a first edge, a second edge, an outward facing side extending along a convex curve between the first edge and the second edge, and an inward facing side extending along a concave curve between the first edge and the second edge;

an engaging track connected to the body at the first edge, wherein the engaging track comprises a tip member, the tip member having an outer surface contiguous with the outward facing side of the body and an inner surface contiguous with the inward facing side of the body, the tip member disposed at an acute an angle from the inward facing side of the body; and a receiving track connected to the body at the second edge, the receiving track comprising a lip member having an outer lip surface contiguous with the inward facing side of the body, and a guard member having an outer guard surface, wherein the lip member and the guard member define an aperture for receiving the engaging track of another slat to form a hinge; and wherein the outer lip surface further comprises a first lip surface, a first curved lip wall, a second curved lip wall, and a second lip surface, and the outer guard surface further comprises a sloped guard wall and an outer guard wall, and the second lip surface and the outer guard wall are offset a distance substantially equal to the distance between the outward facing side and the inward facing side of the body.

3. A retractable rolling shutter assembly operable between a retracted position and a deployed position, comprising:

a spindle;

a plurality of serially linked slats connected to the spindle, each slat comprising:

a body having a first edge, a second edge, an outward facing side extending along a convex curve between the first edge and the second edge, and an inward facing side extending along a concave curve between the first edge and the second edge;

a engaging track connected to the body at the first edge, wherein the engaging track comprises a tip member, the tip member having an outer surface contiguous with the outward facing side of the body and an inner surface contiguous with the inward facing side of the body, the tip member disposed at an acute angle from the inward facing side of the body; and a receiving track connected to the body at the second edge, wherein the receiving track comprises a lip member having an outer lip surface and articulating lip surface, the outer lip surface being contiguous with the inward facing side of the body, a guard member spaced apart from the lip member, the guard member having an outer guard surface and an articulating guard surface, an articulation space wherein a second engaging track of a second slat may hook the lip member through an aperture between the lip member and the guard member thereby forming a hinge, and a receptacle located between the lip member and the guard member that is separated from the articulation space by a first shoulder on the articulating lip surface and a second shoulder on the articulating guard surface, and wherein when a first and a second slat are linked together in a rolled position of the rolling shutter, the outer guard of the first slat is aligned with the body of the second slat, wherein the plurality of slats have bodies of varying heights, the height of each of the slats generally increasing as the distance from the spindle to each slat increases, such that the plurality of slats encircles the spindle in successive layers when the shutter assembly is retracted, and each successive layer of slats lies substantially flush against a previous layer of slats.

4. The retractable rolling shutter assembly of claim 3, wherein the portion of the body nearest the tip member is thickened in relation to the remainder of the body.

5. The retractable rolling shutter assembly of claim 3, wherein the lip member defines an inner cavity, and the inner cavity and the outer guard define an articulation space that is approximately the same shape as the engaging track.

6. The retractable rolling shutter assembly of claim 3, wherein the outer lip surface further comprises a first lip surface, a first curved lip wall, and a second curved lip wall, and a second lip surface, and the outer guard surface further comprises a sloped guard wall and an outer guard wall, and said second lip surface and said outer guard wall having substantially the same curvature as the outward facing side and the inward facing side of the slat.

7. The retractable rolling shutter assembly of claim 3, wherein the outer lip surface further comprises a first lip surface, a first curved lip wall, and a second curved lip wall, and a second lip surface, and the outer guard surface further comprises a sloped guard wall and an outer guard wall, and said second lip surface and said outer guard wall are offset a distance substantially equal to the distance between the outward facing side and the inward facing side of the body.

8. A rolling shutter, comprising:

a plurality of slats, each slat comprising:

a body comprising a curved single wall having a first edge and a second edge, a concave inward facing side and a convex outward facing side;

an engaging track at the first edge of the body, comprising a hooked-shaped member;

a receiving track at the second edge of the body, comprising a lip member defining an articulation space for receiving the engaging track of another slat and including a curved lip wall that is sloped toward the outward facing side of the body, and a guard member including a sloped guard wall having a slope that is complementary to the slope of the curved lip wall, wherein the lip member and guard member are spaced apart and define an aperture opening into the articulation space; and wherein when the inward facing side of the body of a first slat is positioned flush against the outward facing side of the body of a second slat, the curved lip wall of the first slat can be aligned substantially flush against the sloped guard wall of the second slat.

9. A rolling shutter, comprising:

a spindle; and a plurality of slats, each comprising:

a body comprising a curved single wall having a first edge and a second edge, a concave inward facing side and convex outward facing side;

an engaging track at a first edge of the body;

a receiving track at the second edge of the body, comprising a lip member defining an articulation space for receiving the engaging track of another slat, and a guard member including a guard wall having the same curvature as the curved single wall of the body, wherein the lip member and guard member are spaced apart and define an aperture opening into the articulation space; and wherein when the engaging track of a first slat is received in the receiving track of a second slat and the first and second slats are rolled on the spindle, the guard wall of the second slat is aligned with the body of the first slat.

10. The rolling shutter of claim 9, wherein the curved single wall of the body has a thickness, and the lip member and guard wall are offset a distance substantially equal to the thickness of the curved single wall of the body.

* * * * *